US009101813B1

(12) United States Patent
Ranieri

(10) Patent No.: US 9,101,813 B1
(45) Date of Patent: Aug. 11, 2015

(54) TOSSING GAME

(76) Inventor: Tommaso Ranieri, Smithtown, NY (US)

( * ) Notice: Subject to any disclaimer, the term of this patent is extended or adjusted under 35 U.S.C. 154(b) by 843 days.

(21) Appl. No.: 13/313,654

(22) Filed: Dec. 7, 2011

(51) Int. Cl.
*A63B 67/06* (2006.01)
*A63F 9/02* (2006.01)

(52) U.S. Cl.
CPC ..... *A63B 67/06* (2013.01)

(58) Field of Classification Search
CPC .. A63B 67/00; A63B 67/06; A63B 2067/063; A63B 2067/065; A63F 9/02; A63F 9/0243; A63F 9/0278; A63F 2009/0286
USPC ..... 273/317, 348, 126 R; 206/315.1, 445, 206/303, 310; 294/158
See application file for complete search history.

(56) References Cited

U.S. PATENT DOCUMENTS 2,954,978 A * 10/1960 Towle, Jr. ..... 273/126 R
4,203,592 A 5/1980 Quatkemeyer
4,415,080 A * 11/1983 Romine et al. ..... 206/303
4,752,146 A * 6/1988 Buckle ..... 401/35
4,784,263 A * 11/1988 Stanley ..... 206/349
4,936,590 A 6/1990 Palmer
5,125,669 A 6/1992 Kanda
5,419,566 A 5/1995 Byrd
6,015,151 A * 1/2000 Carovillano et al. ..... 273/317
D428,061 S 7/2000 Billodeau et al.
6,932,344 B1 * 8/2005 Soto ..... 273/400
8,104,613 B2 * 1/2012 Trammell ..... 206/310
2004/0108652 A1 6/2004 Vaden
2005/0263532 A1 * 12/2005 Huang ..... 221/1
2006/0097454 A1 5/2006 Mattson
2006/0119031 A1 * 6/2006 Riley et al. ..... 273/126 R
2010/0270192 A1 * 10/2010 Ali et al. ..... 206/372
2013/0062830 A1 * 3/2013 Brunner ..... 273/348

* cited by examiner

*Primary Examiner* — Raleigh W Chiu

(57) ABSTRACT

A tossing game having at least eight multi-colored tossing discs, at least a first target disc, the target disc has a diameter smaller than that of each tossing disc, each tossing disc and each target disc has a center channel wherein a carrier having a carrier pin is inserted through the center channels of each disc, a threaded shaft is at a first end of the carrier pin and a flange with a diameter larger than that of the center channels of each disc is at a second end of the carrier pin, a handle having a threaded bottom end which removably engages the threaded shaft of the carrier pin, wherein the discs are sandwiched between the flange and the handle.

7 Claims, 4 Drawing Sheets

(ISO View)

(Bottom View)

(Exploded View)

(Cross-sectional View)

(In-use View)

TOSSING GAME

FIELD OF THE INVENTION

The present invention is directed to a game wherein players toss large discs at a small disc and the player whose disc lands closest to it wins.

BACKGROUND OF THE INVENTION

Many individuals enjoy tossing games such as bocce ball and horseshoes. The present invention features a novel tossing game. Players toss large discs at a smaller disc. The player whose disc lands the closest to the smaller disc wins the game.

SUMMARY

The present invention features a tossing game. In some embodiments, the tossing game comprises at least a first tossing disc, a second tossing disc, a third tossing disc, a fourth tossing disc, a fifth tossing disc, a sixth tossing disc, a seventh tossing disc, and an eighth tossing disc, the first tossing disc and the second tossing disc are a first color, the third tossing disc and the fourth tossing disc are a second color, the fifth tossing disc and the sixth tossing disc are a third color, and the seventh tossing disc and the eighth tossing disc are a fourth color; at least a first target disc, the target disc has a diameter smaller than that of each tossing disc, each tossing disc and each target disc has a center channel; and a carrier comprising a carrier pin insertable through the center channels of each disc, a threaded shaft is disposed at a first end of the carrier pin and a flange is disposed at a second end of the carrier pin, the flange has a diameter larger than that of the center channels of each disc; a handle having a threaded bottom end, the threaded bottom end removably engages the threaded shaft of the carrier pin, wherein the discs are sandwiched between the flange and the handle.

In some embodiments, the colors are selected from the group consisting of blue, black, yellow, and red. In some embodiments, the tossing discs are about 4.5 inches in diameter. In some embodiments, the tossing discs are about 1 inch in thickness. In some embodiments, a washer is sandwiched between the handle and the discs. In some embodiments, the handle is rectangular and has a hollow center.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
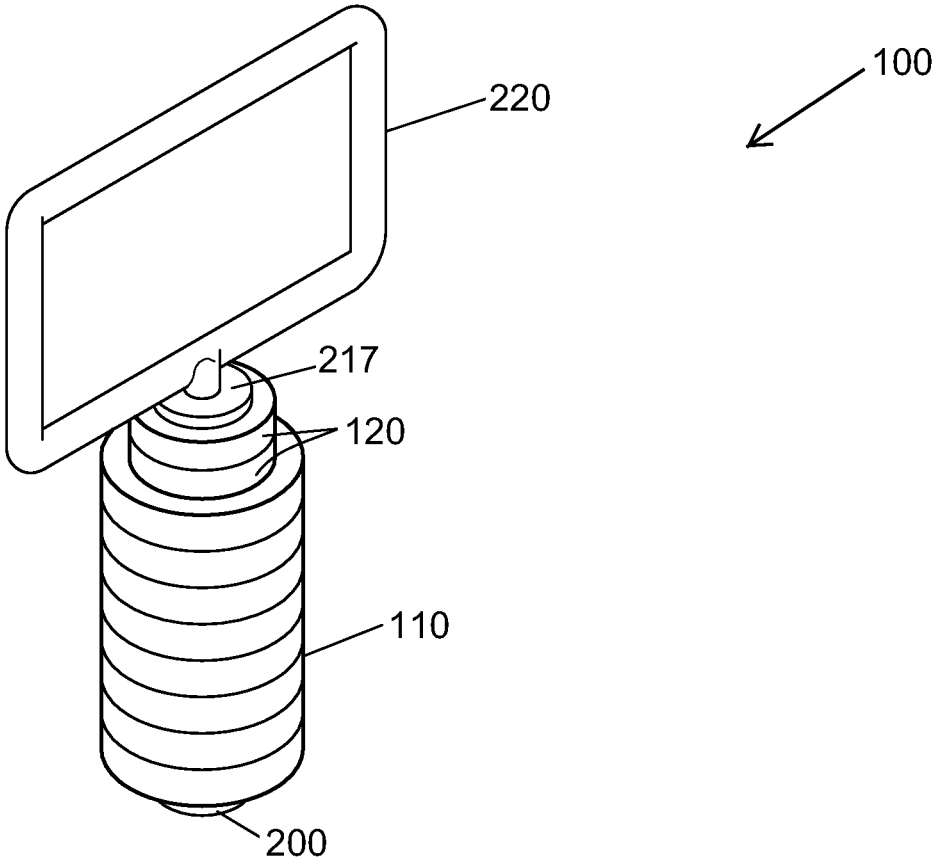
FIG. 1 is a perspective view of the system of the present invention.
Figure 2:
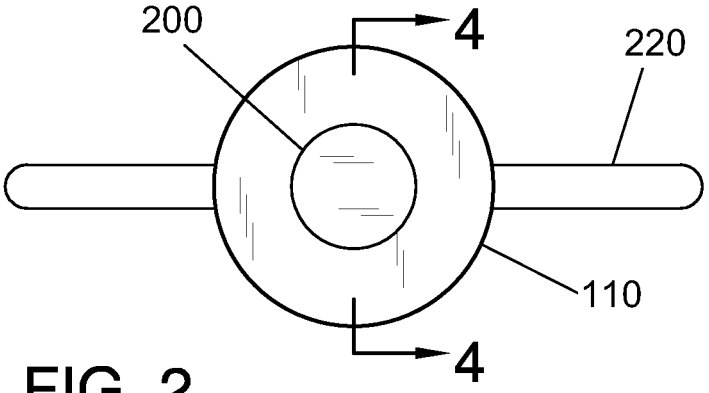
FIG. 2 is a bottom view of the system of the present invention.
Figure 3:
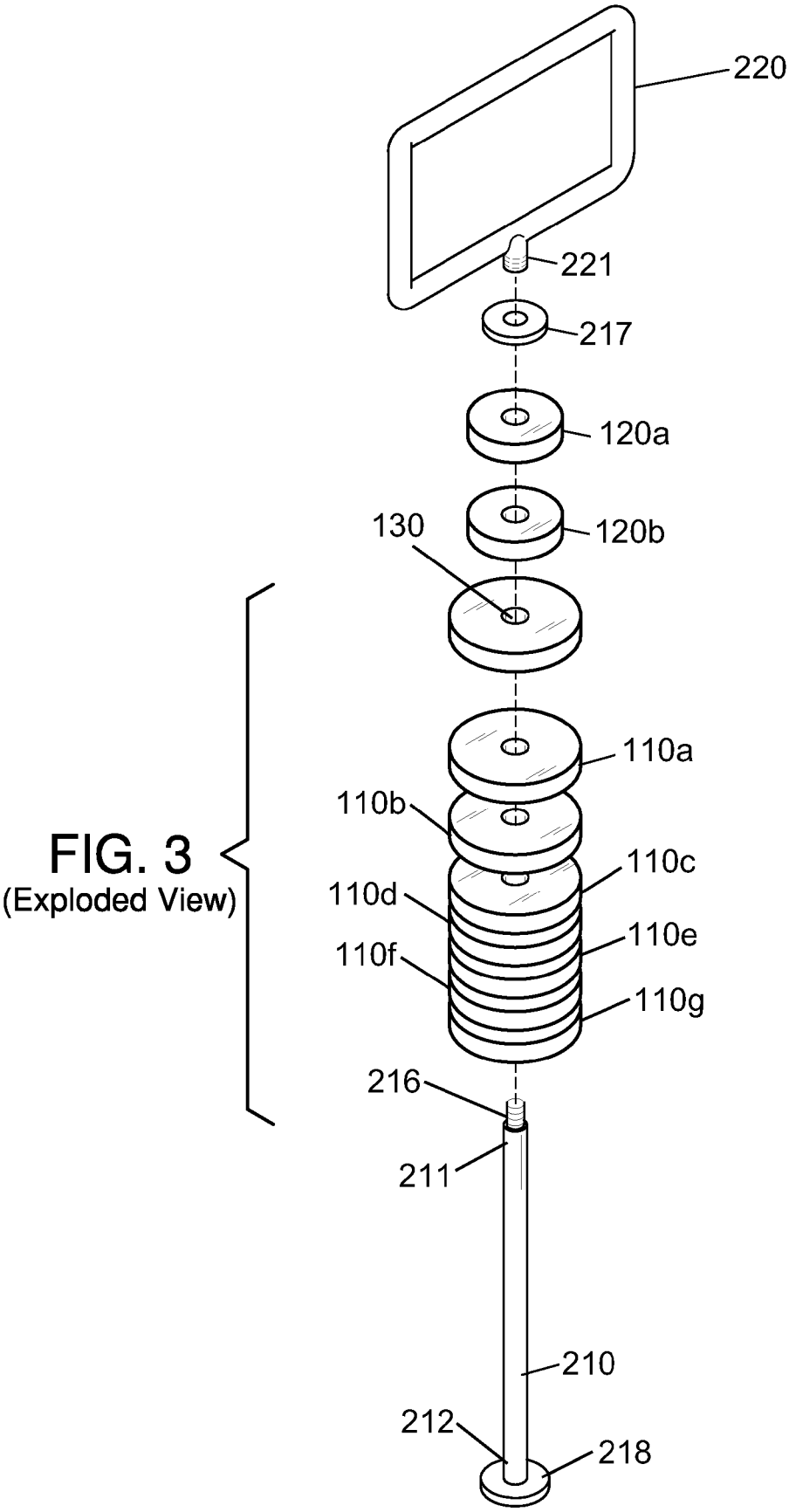
FIG. 3 is an exploded view of the system of the present invention.

Referring now to FIG. 1-5, the present invention features a novel tossing game 100. The game 100 comprises a plurality of tossing discs 110 and at least one target disc 120. The tossing discs 110 have a diameter larger than that of the target disc 120. Each tossing disc 110 and each target disc 120 is a flat disc.

In some embodiments, the game 100 comprises eight tossing discs, e.g., a first tossing disc 110*a*, a second tossing disc 110*b*, a third tossing disc 110*c*, a fourth tossing disc 110*c*, a fifth tossing disc 110*d*, a sixth tossing disc 110*e*, a seventh tossing disc 110*f*, and an eighth tossing disc 110*g*. In some embodiments, the first tossing disc 110*a* and the second tossing disc 110*b* are a first color. In some embodiments, the third tossing disc 110*c* and the fourth tossing disc 110*c* are a second color. In some embodiments, the fifth tossing disc 110*d* and the sixth tossing disc 110*e* are a third color. In some embodiments, the seventh tossing disc 110*f* and the eighth tossing disc 110*g* are a fourth color.

In some embodiments, the game 100 comprises two target discs 120, e.g., a first target disc 120*a* and a second target disc 120*b*. In some embodiments, the target discs 120 have the same diameter. In some embodiments, the tossing discs 110 have the same diameter. In some embodiments, the target discs 120 are a fifth color.

In some embodiments, the colors are selected from the group consisting of blue, black, yellow, and red.

Each tossing disc 110 and each target disc 120 has a center channel 130.

Figure 5:
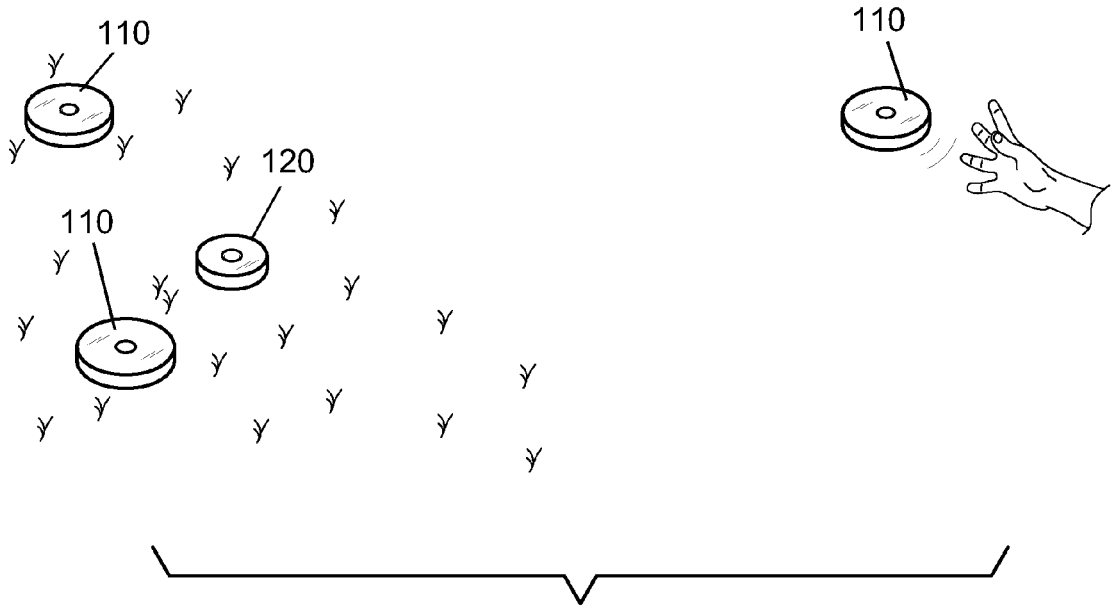
FIG. 5 is an in-use view of the system of the present invention.

As shown in FIG. 5, to play the game 100, the target disc 120 is placed at a particular location. Each player (or group of players) takes a pair of tossing discs 110 (of the same color). The players take turns tossing the tossing discs 110 at the target disc 120. The player whose tossing disc 110 is the closest to the target disc 120 wins the game.

In some embodiments, the game 100 comprises a carrier 200. The carrier 200 comprises a carrier pin 210 adapted to be inserted through the center channels 130 of each target disc 120 and each tossing disc 110. A threaded shaft 216 is disposed at the first end 211 of the carrier pin 210. A flange 218 is disposed at the second end 212 of the carrier pin 210. The flange 218 has a diameter larger than that of the center channels 130 of the discs 110, 120. Thus, when the discs 110, 120 are stacked atop each other on the carrier pin 210, the discs are held in place atop the flange 218.

Figure 4:
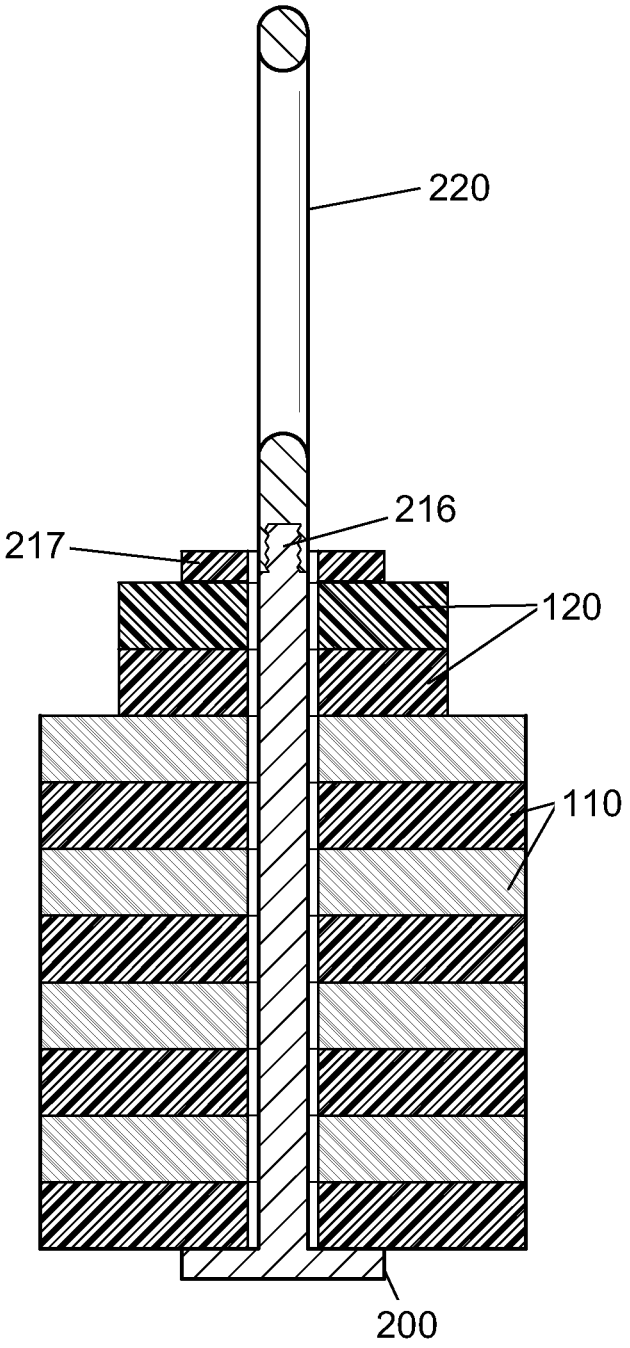
FIG. 4 is a cross sectional view of the system of the present invention.

The carrier 200 further comprises a handle 220. The handle 220 has a bottom end 221. The bottom end 221 is threaded and is adapted to engage the threaded shaft 216 of the carrier pin 210. In some embodiments, a washer 217 is sandwiched between the handle 220 and the discs 210, 220 as shown in FIG. 1 and FIG. 4. In some embodiments, the handle 220 is rectangular and has a hollow center, however the handle 220 is not limited to this configuration.

The discs may be constructed in a variety of sizes. For example, in some embodiments, the tossing discs 110 are about 4.5 inches in diameter. In some embodiments, the tossing discs 110 are about 1 inch in thickness. In some embodiments, the tossing discs 110 are between about 3 to 6 inches in diameter. In some embodiments, the tossing discs 110 are between about 5 to 8 inches in diameter. The present invention is not limited to the aforementioned dimensions.

As used herein, the term "about" refers to plus or minus 10% of the referenced number. For example, an embodiment wherein the tossing disc 110 is about 5 inches in diameter includes a tossing disc 110 that is between 4.5 and 5.5 inches in diameter.

The disclosures of the following U.S. Patents are incorporated in their entirety by reference herein: U.S. Pat. No. 4,203,592; U.S. Pat. No. 4,936,590; U.S. Pat. No. 5,125,669; U.S. Pat. No. 5,419,566; U.S. Pat. No. 6,015,151; U.S. Design Pat. No. D428061; U.S. Patent Application No. 2004/0108652; U.S. Patent Application No. 2006/0097454.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A tossing game (100) comprising:

(a) at least a first tossing disc (110*a*), a second tossing disc (110*b*), a third tossing disc (110*c*), a fourth tossing disc (110*c*, a fifth tossing disc (110*d*), a sixth tossing disc (110*e*), a seventh tossing disc (110*f*), and an eighth tossing disc (110*g*), the first tossing disc (110*a*) and the second tossing disc (110*b*) are a first color, the third tossing disc (110*c*) and the fourth tossing disc (110*c*) are a second color, the fifth tossing disc (110*d*) and the sixth tossing disc (110*e*) are a third color, and the seventh tossing disc (110*f*) and the eighth tossing disc (110*g*) are a fourth color;

(b) at least a first target disc (120), the target disc (120) has a diameter smaller than that of each tossing disc (110), each tossing disc (110) and each target disc (120) has a center channel (130);

wherein each tossing disc (110) and each target disc (120) is a flat disc; and (c) a carrier (200) comprising:

(i) a carrier pin (210) insertable through the center channels (130) of each disc (110, 120), a threaded shaft (216) is disposed at a first end (211) of the carrier pin (210) and a flange (218) is disposed at a second end (212) of the carrier pin (210), the flange (218) has a diameter larger than that of the center channels (130) of each disc (110, 120); and (ii) a handle (220) having a threaded bottom end (221), the threaded bottom end (221) removably engages the threaded shaft (216) of the carrier pin (210), wherein the discs are sandwiched between the flange (218) and the handle (220).

2. The game (100) of claim 1, wherein the colors are selected from the group consisting of blue, black, yellow, and red.

3. The game (100) of claim 1, wherein the tossing discs (110) are about 4.5 inches in diameter.

4. The game (100) of claim 1, wherein the tossing discs (110) are about 1 inch in thickness.

5. The game (100) of claim 1, wherein, a washer (217) is sandwiched between the handle (220) and the discs (210, 220).

6. The game (100) of claim 1, wherein the handle (220) is rectangular and has a hollow center.

7. A tossing game (100) consisting of:

(a) at least a first tossing disc (110*a*), a second tossing disc (110*b*), a third tossing disc (110*c*), a fourth tossing disc (110*c*, a fifth tossing disc (110*d*), a sixth tossing disc (110*e*), a seventh tossing disc (110*f*), and an eighth tossing disc (110*g*), the first tossing disc (110*a*) and the second tossing disc (110*b*) are a first color, the third tossing disc (110*c*) and the fourth tossing disc (110*c*) are a second color, the fifth tossing disc (110*d*) and the sixth tossing disc (110*e*) are a third color, and the seventh tossing disc (110*f*) and the eighth tossing disc (110*g*) are a fourth color;

(b) at least a first target disc (120), the target disc (120) has a diameter smaller than that of each tossing disc (110), each tossing disc (110) and each target disc (120) has a center channel (130);

wherein each tossing disc (110) and each target disc (120) is a flat disc; and (c) a carrier (200) consisting of:

(i) a carrier pin (210) insertable through the center channels (130) of each disc (110, 120), a threaded shaft (216) is disposed at a first end (211) of the carrier pin (210) and a flange (218) is disposed at a second end (212) of the carrier pin (210), the flange (218) has a diameter larger than that of the center channels (130) of each disc (110, 120); and (ii) a handle (220) having a threaded bottom end (221), the threaded bottom end (221) removably engages the threaded shaft (216) of the carrier pin (210), wherein the discs are sandwiched between the flange (218) and the handle (220).

* * * * *